US007806553B1

(12) United States Patent
Fluelling

(10) Patent No.: US 7,806,553 B1
(45) Date of Patent: Oct. 5, 2010

(54) ILLUMINATED COSMETIC CARRYING BAG AND ASSOCIATED METHOD

(76) Inventor: Vurnette Fluelling, 33 Orchard La., Marlton, NJ (US) 08053

( * ) Notice: Subject to any disclaimer, the term of this patent is extended or adjusted under 35 U.S.C. 154(b) by 285 days.

(21) Appl. No.: 11/973,928

(22) Filed: Oct. 11, 2007

Related U.S. Application Data

(60) Provisional application No. 60/850,826, filed on Oct. 12, 2006.

(51) Int. Cl.
*F21V 33/00* (2006.01)

(52) U.S. Cl. ..... 362/156; 362/155; 362/394

(58) Field of Classification Search ..... 362/154, 362/155, 156, 295, 394; 150/112, 113, 114, 150/115, 116, 117, 118, 119, 145
See application file for complete search history.

(56) References Cited

U.S. PATENT DOCUMENTS 1,464,176 A * 8/1923 Freund ..... 150/117
3,307,027 A * 2/1967 Lins et al. ..... 362/155
4,192,365 A 3/1980 Siegel
5,048,582 A 9/1991 Whitfield
6,491,074 B1 12/2002 Roegner
6,582,093 B1 * 6/2003 Branaugh et al. ..... 362/156
7,198,083 B1 * 4/2007 Sartena ..... 150/118
2006/0250785 A1 * 11/2006 Cugini et al. ..... 362/156

* cited by examiner

*Primary Examiner*—Y My Quach Lee

(57) ABSTRACT

An illuminable cosmetic carrying bag includes a body with a plurality of walls arranged in such a manner to create a storage chamber therein. One of such walls is transparent and situated along an entire anterior side of the body, and the body further has a protective flap pivotally coupled to a bottom edge of the transparent wall. Such a protective flap covers an entire surface area of the transparent wall when articulated to a closed position. The device further includes a mechanism for removably displaying the cosmetic items on an interior face of the protective flap, and a mechanism for illuminating the storage chamber and the protective flap so that the cosmetic items are illuminated while displayed on the interior face of the protective flap.

9 Claims, 15 Drawing Sheets

ILLUMINATED COSMETIC CARRYING BAG AND ASSOCIATED METHOD

CROSS REFERENCE TO RELATED APPLICATIONS

This application claims the benefit of U.S. Provisional Application No. 60/850,826, filed Oct. 12, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to carrying bags and, more particularly, to an illuminated cosmetic carrying bag for storing and displaying cosmetic items.

2. Prior Art

An indispensable accessory carried by millions of women is a handbag. A handbag, also known as a pocket book or purse, can be manufactured from a variety of materials such as leather, straw, canvas, or silk and is designed to efficiently store a woman's personal belongings. Manufactured in a variety of sizes, colors and styles, all intended to appeal to the individual needs of the consumer, handbags are used for everything from carrying an extra tube of lipstick to storing wallets, cellular telephones, important papers and even extra clothing. Regardless of whether one is clutching a fancy beaded evening bag, a practical and stylish midsize purse, or a bulky, oversized tote loaded with enough supplies to last a lifetime, for most women, a handbag is the one necessity they will never leave home without.

Although there is little dispute that handbags are practical and necessary items, use of one is not always without drawbacks. Specifically, trying to locate individual items stored within the handbag can sometimes be difficult. Not surprisingly, items such as a cellular telephone, favorite tube of lipstick or even a toll ticket can be extremely difficult to locate when piled into a purse along with items such as a wallet, receipts, personal hygiene products and cosmetics. This problem is of particular concern during evening hours, or when one is in a darkened night club or similar environment.

As many female consumers would attest, feeling their way around a wallet, loose change, eyeglasses and various receipts, all in order to find a stick of chewing gum or breath mint before meeting a blind date in a darkened dance club, can be a frustrating experience. Impractical, the problem of not being able to clearly see within one's handbag can also be dangerous. As scary as it might seem, standing beside one's car in a deserted parking garage or outside one's apartment door, while aimlessly hunting through a crowded satchel in search of a set of car or door keys, can leave a woman vulnerable and even susceptible to attack. Obviously, it would be advantageous to provide a means for enabling persons to easily locate and access the various contents of their purse at all times.

U.S. Pat. No. 4,192,365 to Siegel discloses a organizer handbag having an internal compartment divided by transverse partition panels into multiple sub-compartments. Various storage components such as a removable card carrying case, pocketbook, key retainer and pouch are secured at said partitions. An external storage pouch for letters and documents is secured to one side of the handbag. Interior pockets for sundry items are also provided. In the closed position, a hinged external flap obscures the internal organizer storage components for security and to give a relatively trim and chic exterior appearance. Unfortunately, this prior art example does not include an illumination device.

U.S. Pat. No. 5,048,582 to Whitfield discloses a compartmented handbag having a plurality of interior compartments including a directional map that identifies the contents and/or locations of the compartments within the handbag, making the contents of the compartments easily accessible. The compartments are numbered and the directional map includes a list of the numbered compartments and identifying indicia which is individually correlated to correspond with the compartments. Unfortunately, this prior art example does not include an illumination device.

U.S. Pat. No. 6,491,074 to Roegner discloses a purse for carrying and organizing various articles with compartments, panels, pockets and flaps shaped, sized, located and connected to each other in a manner that allows superior securement of and access to articles of certain shapes (such as drinking bottles, umbrellas, eyeglasses, credit cards and so on), while also including segregated storage spaces to allow additional storage of all kinds of other articles. The purse of the present invention may be implemented as an organizing insert that can be switched between a variety of outer shells, as fashion, weather conditions and whim dictate. Unfortunately, this prior art example does not include an illumination device.

Accordingly, the present invention is disclosed in order to overcome the above noted shortcomings. The present invention is convenient and easy to use, lightweight yet durable in design, and designed for storing and displaying cosmetic items. The illuminated cosmetic carrying device is simple to use, inexpensive, and designed for many years of repeated use.

BRIEF SUMMARY OF THE INVENTION

In view of the foregoing background, it is therefore an object of the present invention to provide an apparatus for storing and displaying cosmetic items. These and other objects, features, and advantages of the invention are provided by an illuminable cosmetic carrying bag.

An illuminable cosmetic carrying bag includes a body with a plurality of walls arranged in such a manner to effectively create a storage chamber therein. One of such walls is transparent and situated along an entire anterior side of the body, and the body further has a protective flap pivotally coupled to a bottom edge of the transparent wall. Such a protective flap covers an entire surface area of the transparent wall when articulated to a closed position.

The device further includes a mechanism for removably displaying the cosmetic items on an interior face of the protective flap. Such a cosmetic item displaying mechanism automatically and conveniently toggles the illuminating mechanism between illuminated and non-illuminated modes when adapted between open and closed positions respectively. The cosmetic item displaying mechanism includes a plurality of straps adjustably attached to the interior face of the protective flap. Such straps hold the cosmetic items along the interior face and openly display the cosmetic items when the protective flap is adapted to an open position.

The device further includes a mechanism for illuminating the storage chamber and the protective flap so that the cosmetic items are advantaegously illuminated while displayed on the interior face of the protective flap. Such an illuminating mechanism includes a battery and a diode electrically coupled directly to the battery for ensuring that current flows in one direction. A switch is electrically coupled to the diode and positioned downstream thereof, and an electromagnetic conducting assembly is electrically coupled directly to the switch. Such an electromagnetic conducting assembly includes a conductive core member, a conductive coil helically wrapped about the core member, a pivot hinge spaced from the core member, an L-shaped armature pivotally mated to the pivot hinge, and an insulating rib directly intercalated between an end of the armature and the conductive contact respectively. Such a core member and such a conductive coil effectively cooperate for generating an electromagnetic force that causes the armature to pivot about the pivot hinge and bias the conductive contact to the second terminal and thereby transfer the current to the lamp.

The illuminating mechanism further includes first and second terminals spaced apart and electrically disengaged when the switch is adapted to an open position. A conductive contact is attached to the first terminal, a fuse is electrically coupled directly to the second terminal, and a lamp is electrically coupled directly to the fuse. The battery conveniently generates and transmits the current to the diode when the switch is adapted to a closed position by pivoting the cosmetic item displaying mechanism to an open position and thereby allowing the current to be transmitted to the electromagnetic conducting assembly for biasing the conductive contact along an arcuate path and thereby engaging the second terminal so that the current is allowed to freely flow through the fuse and illuminate the lamp.

A method for storing and displaying cosmetic items includes the steps of: providing a body with a plurality of walls arranged in such a manner to create a storage chamber therein; pivotally coupling a protective flap to a bottom edge of a transparent one of the walls in such a manner that the protective flap covers an entire surface area of the transparent wall when articulated to a closed position; removably displaying the cosmetic items on an interior face of the protective flap; and automatically illuminating the storage chamber and the protective flap so that the cosmetic items are illuminated while displayed on the interior face of the protective flap when the cosmetic item displaying mechanism is adapted between to an open position.

The method further includes the steps of: providing a battery; electrically coupling a diode electrically and directly to the battery for ensuring that current flows in one direction; electrically coupling a switch to the diode by positioning the switch downstream of the diode; directly coupling an electromagnetic conducting assembly directly to the switch; adapting the switch to an open position; spacing apart first and second terminals by electrically disengaging the first and second terminals; attaching a conductive contact to the first terminal; electrically coupling a fuse directly to the second terminal; electrically coupling a lamp directly to the fuse; adapting the switch to a closed position; the battery to generating and transmitting the current to the diode by pivoting the cosmetic item displaying mechanism to an open position; transmitting the current to the electromagnetic conducting assembly; biasing the conductive contact along an arcuate path; and the conductive contact engaging the second terminal so that the current is allowed to freely flow through the fuse and illuminate the lamp.

The method further includes the steps of: providing a conductive core member and a conductive coil helically wrapped about the core member; spacing a pivot hinge from the core member; pivotally mating an L-shaped armature to the pivot hinge; directly intercalating an insulating rib between an end of the armature and the conductive contact respectively; and the core member and the conductive coil generating an electromagnetic force and thereby causing the armature to pivot about the pivot hinge and bias the conductive contact to the second terminal for transferring the current to the lamp.

The method further includes the steps of: adjustably attaching a plurality of straps to the interior face of the protective flap; and positioning the cosmetic items against the straps in such a manner that the straps hold the cosmetic items along the interior face and openly display the cosmetic items when the protective flap is adapted to an open position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
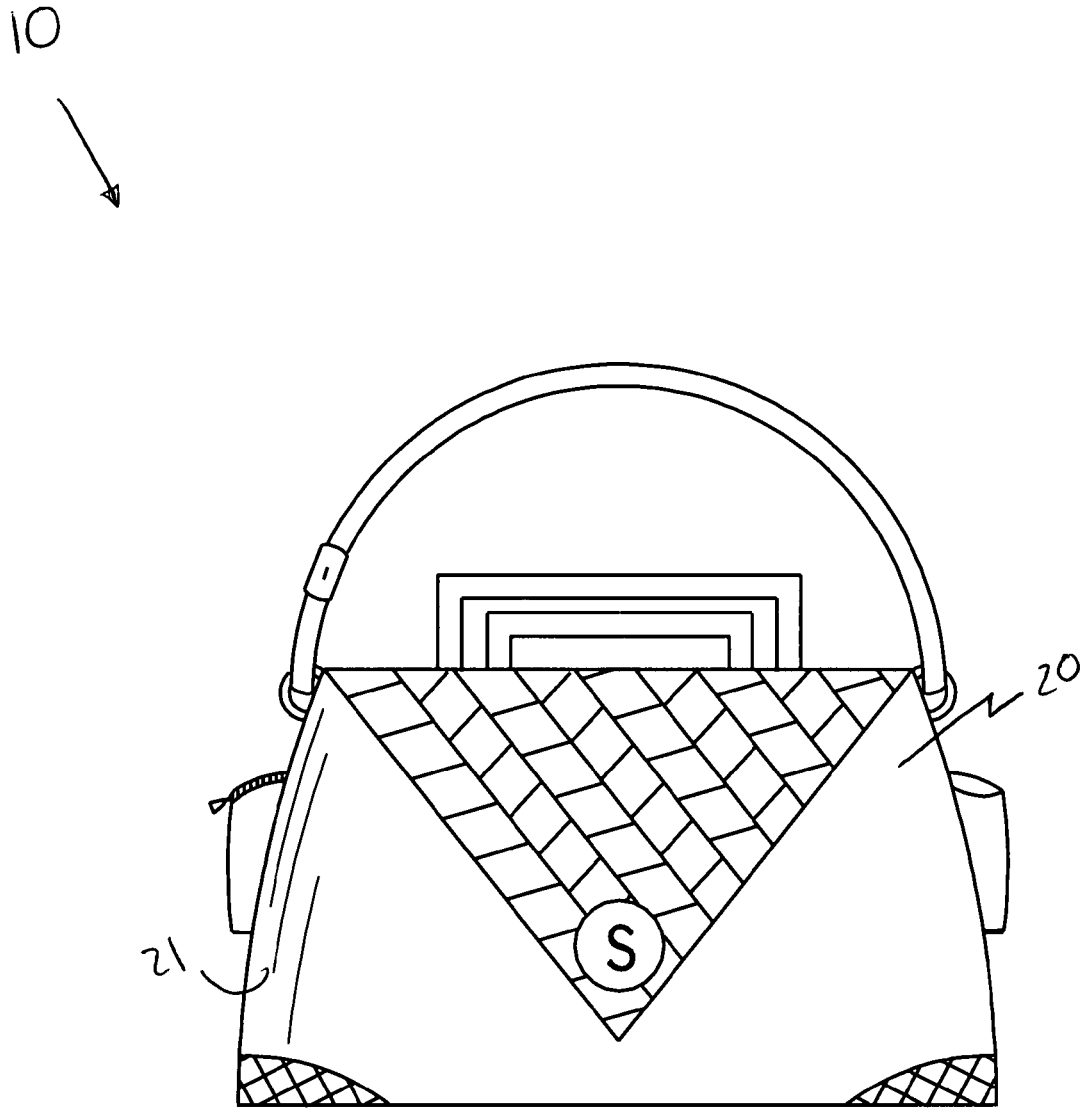
FIG. 1 is a front elevational view of an illuminable cosmetic carrying bag, in accordance with the present invention.
Figure 2:
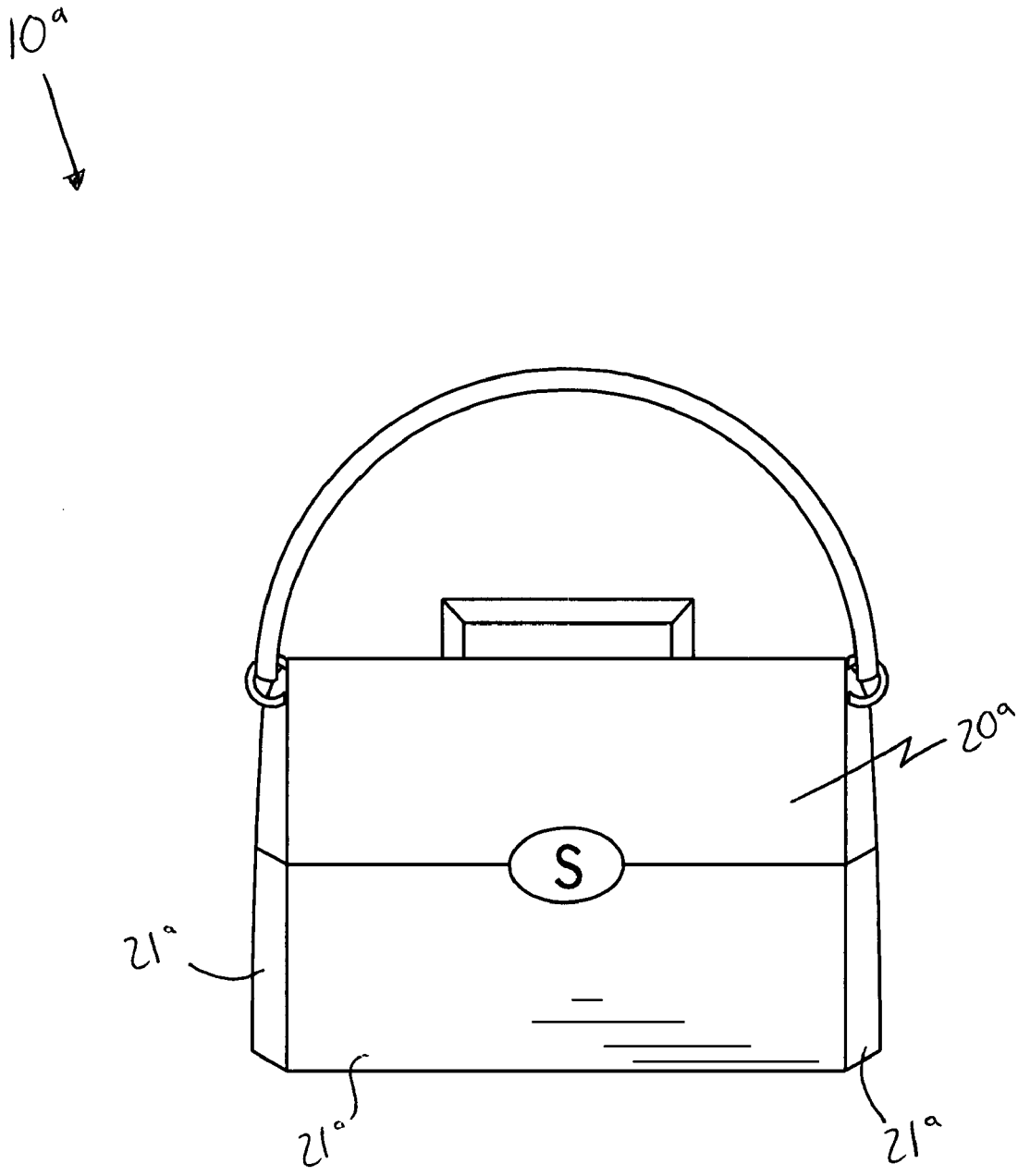
FIG. 2 is a front elevational view of an alternate embodiment of an illuminable cosmetic carrying bag, in accordance with the present invention.
Figure 3:
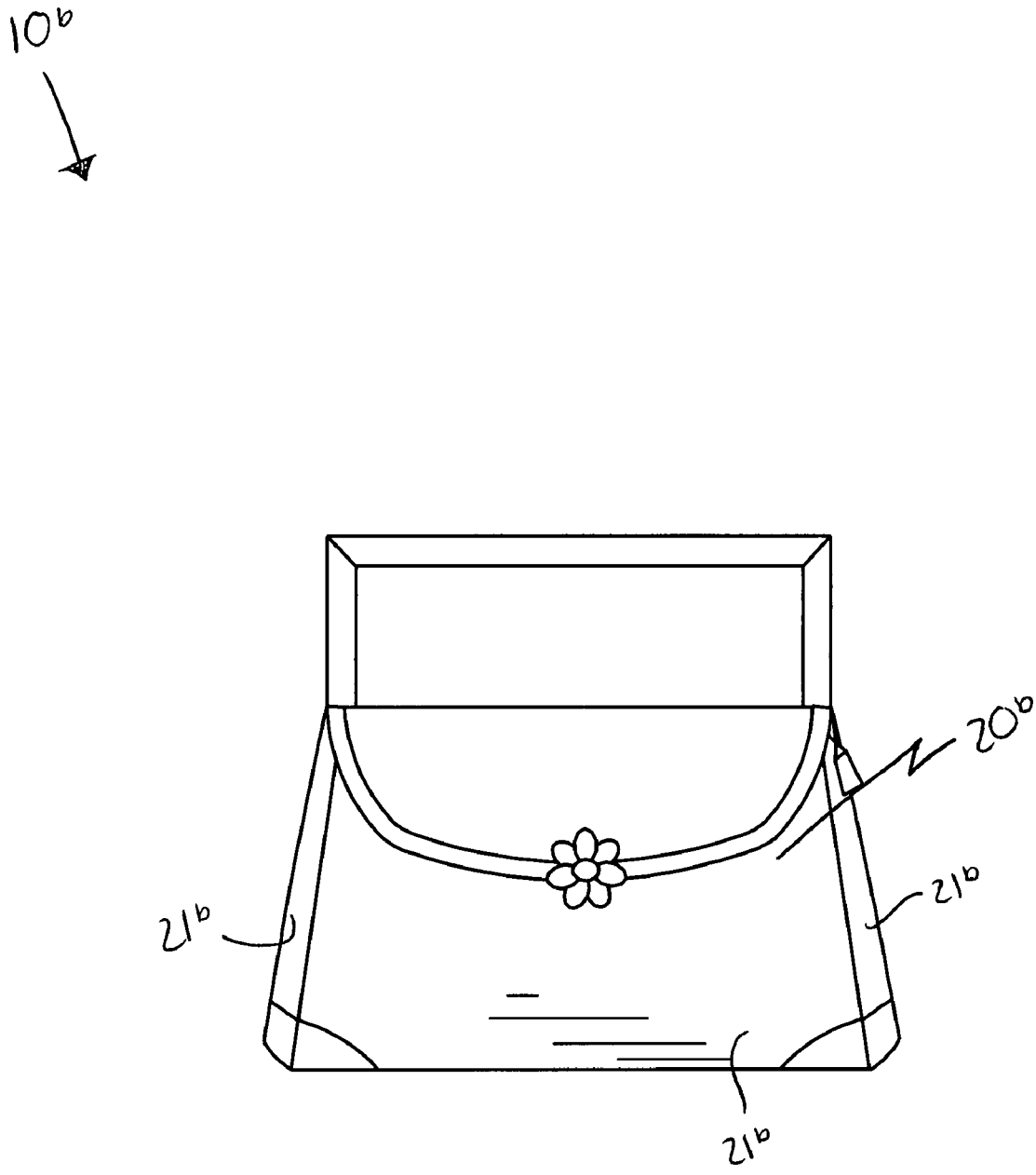
FIG. 3 is a front elevational view of an alternate embodiment of an illuminable cosmetic carrying bag, in accordance with the present invention.
Figure 4:
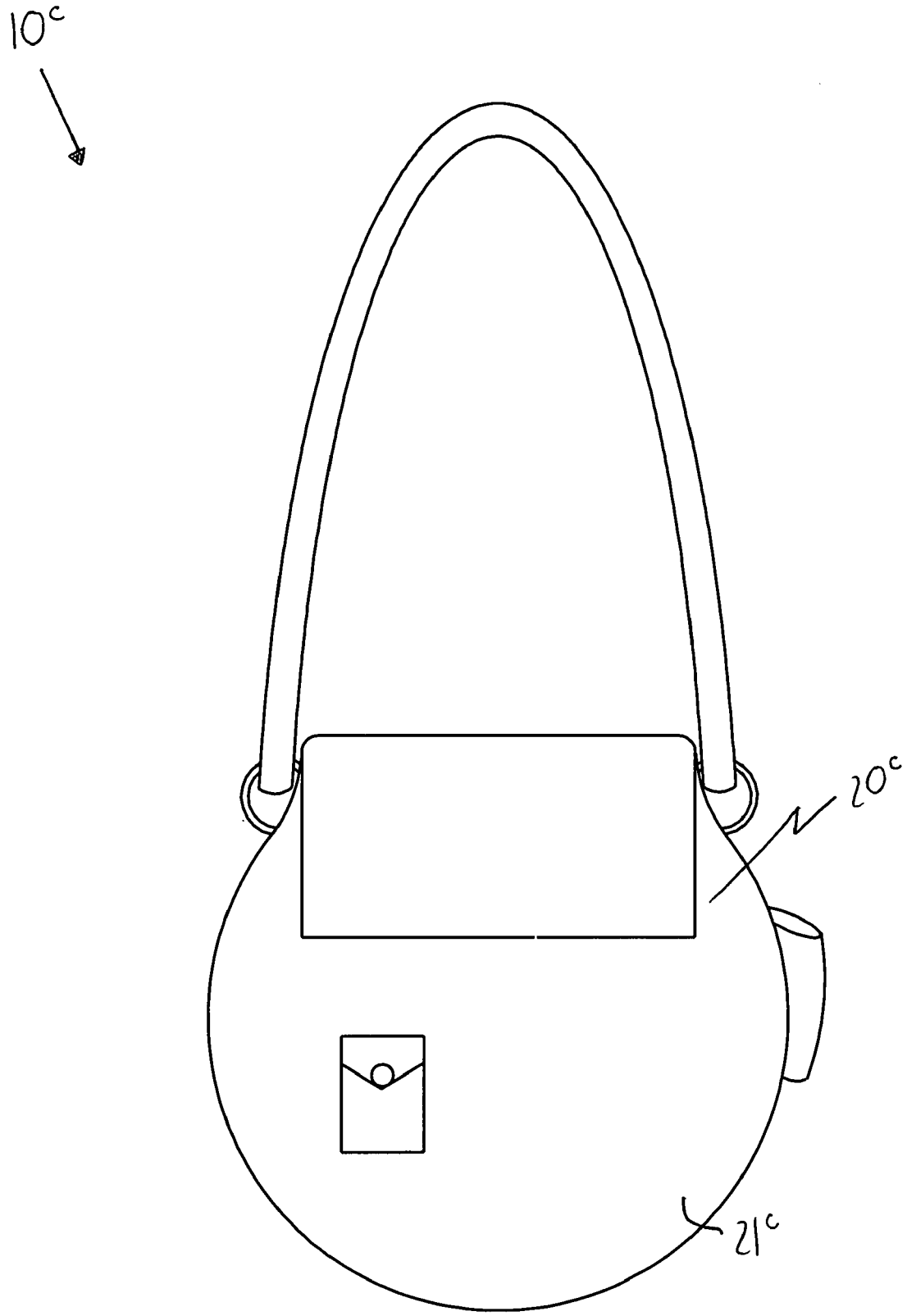
FIG. 4 is a front elevational view of an alternate embodiment of an illuminable cosmetic carrying bag, in accordance with the present invention.
Figure 5:
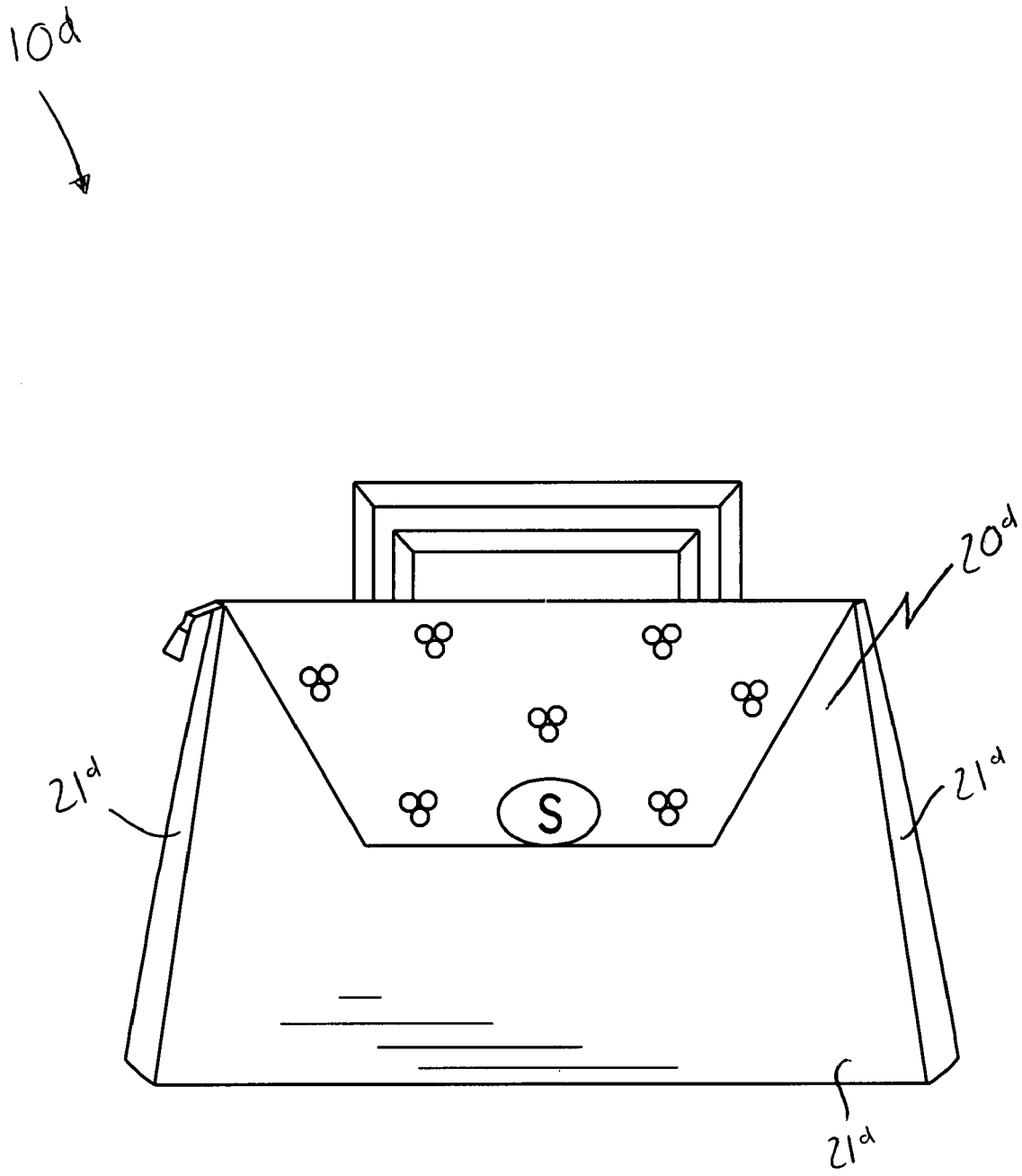
FIG. 5 is a front elevational view of an alternate embodiment of an illuminable cosmetic carrying bag, in accordance with the present invention.
Figure 6:
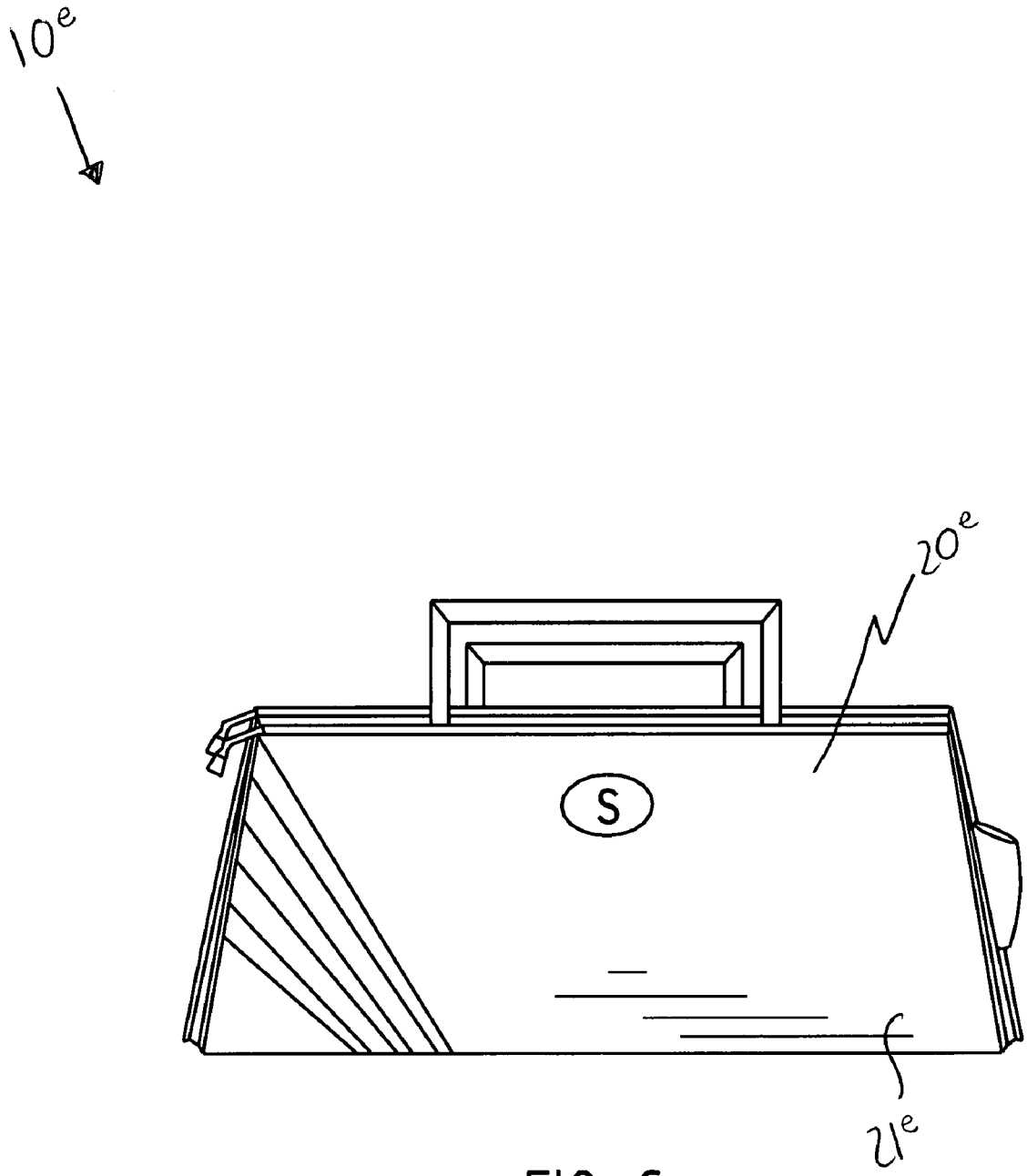
FIG. 6 is a front elevational view of an alternate embodiment of an illuminable cosmetic carrying bag, in accordance with the present invention.
Figure 7:
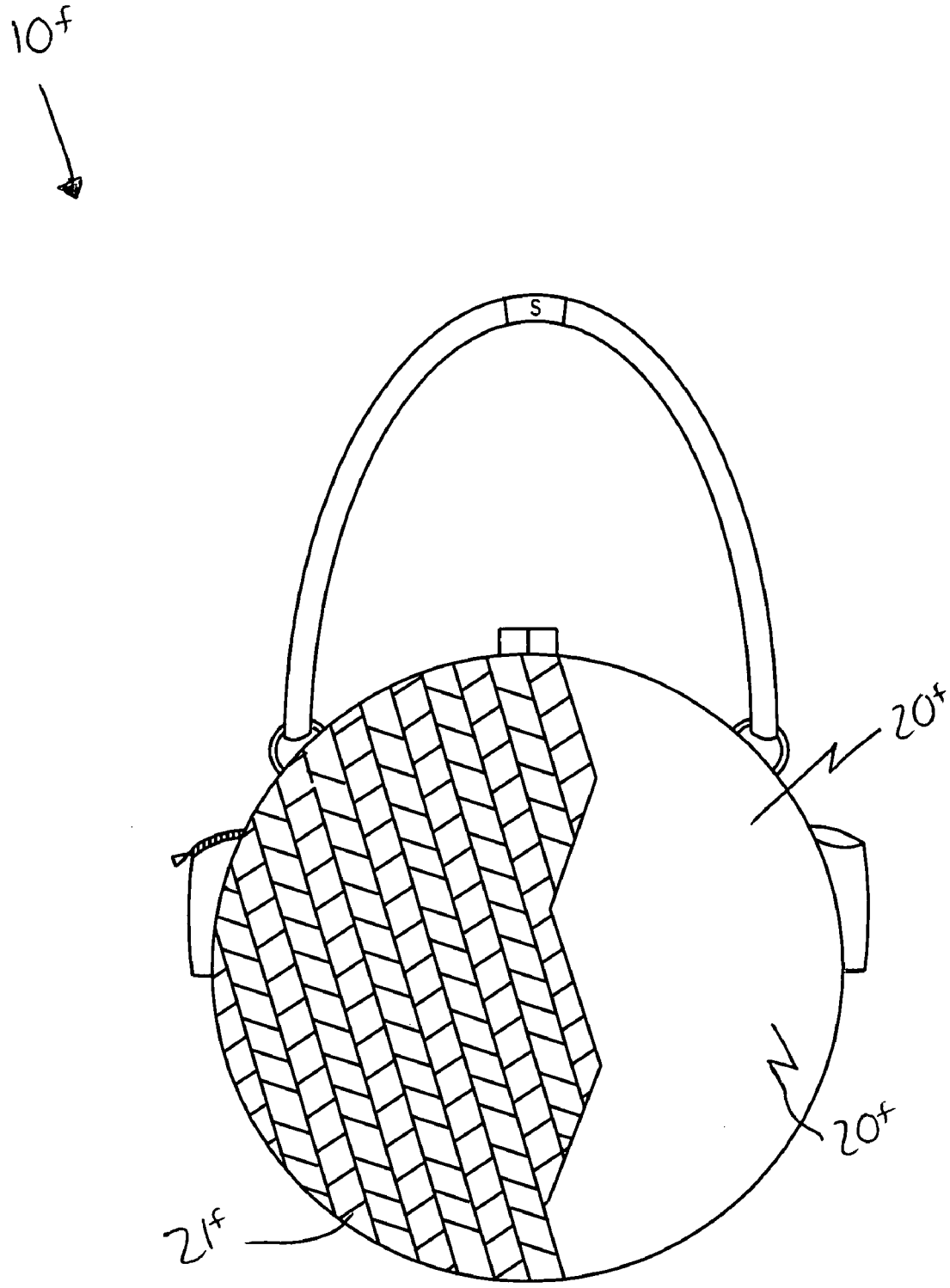
FIG. 7 is a front elevational view of an alternate embodiment of an illuminable cosmetic carrying bag, in accordance with the present invention.
Figure 8:
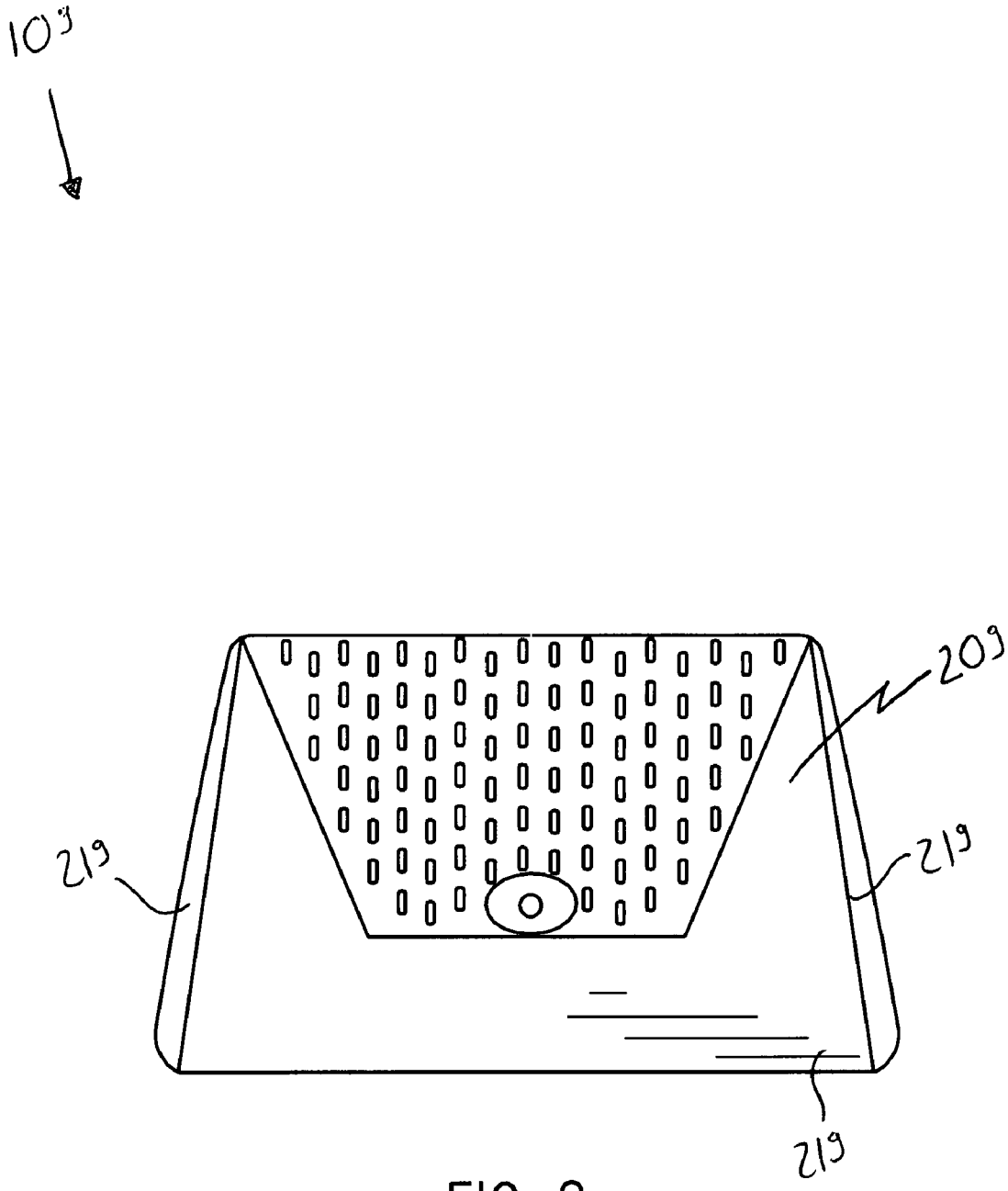
FIG. 8 is a front elevational view of an alternate embodiment of an illuminable cosmetic carrying bag, in accordance with the present invention.
Figure 9:
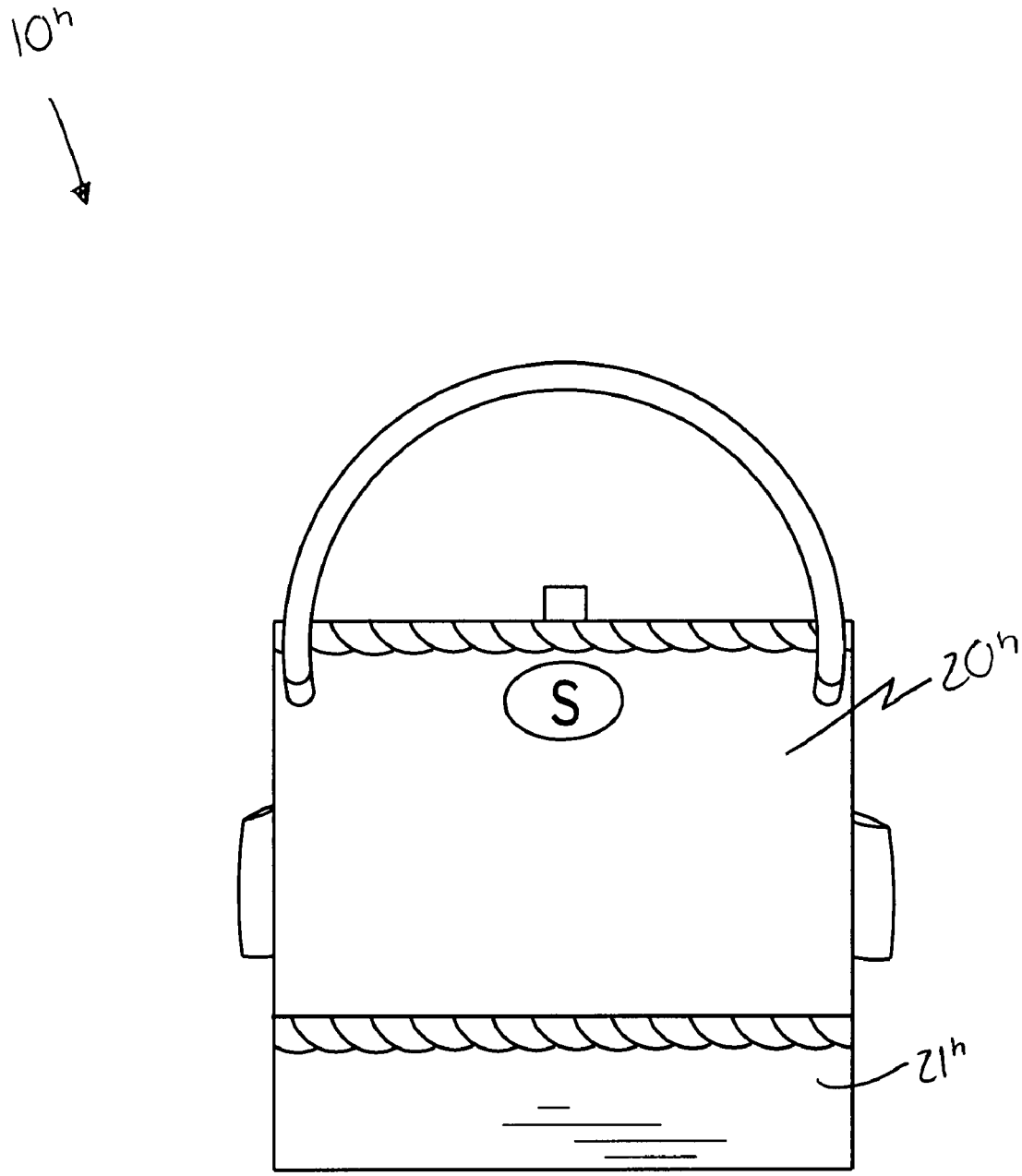
FIG. 9 is a front elevational view of an alternate embodiment of an illuminable cosmetic carrying bag, in accordance with the present invention.
Figure 10:
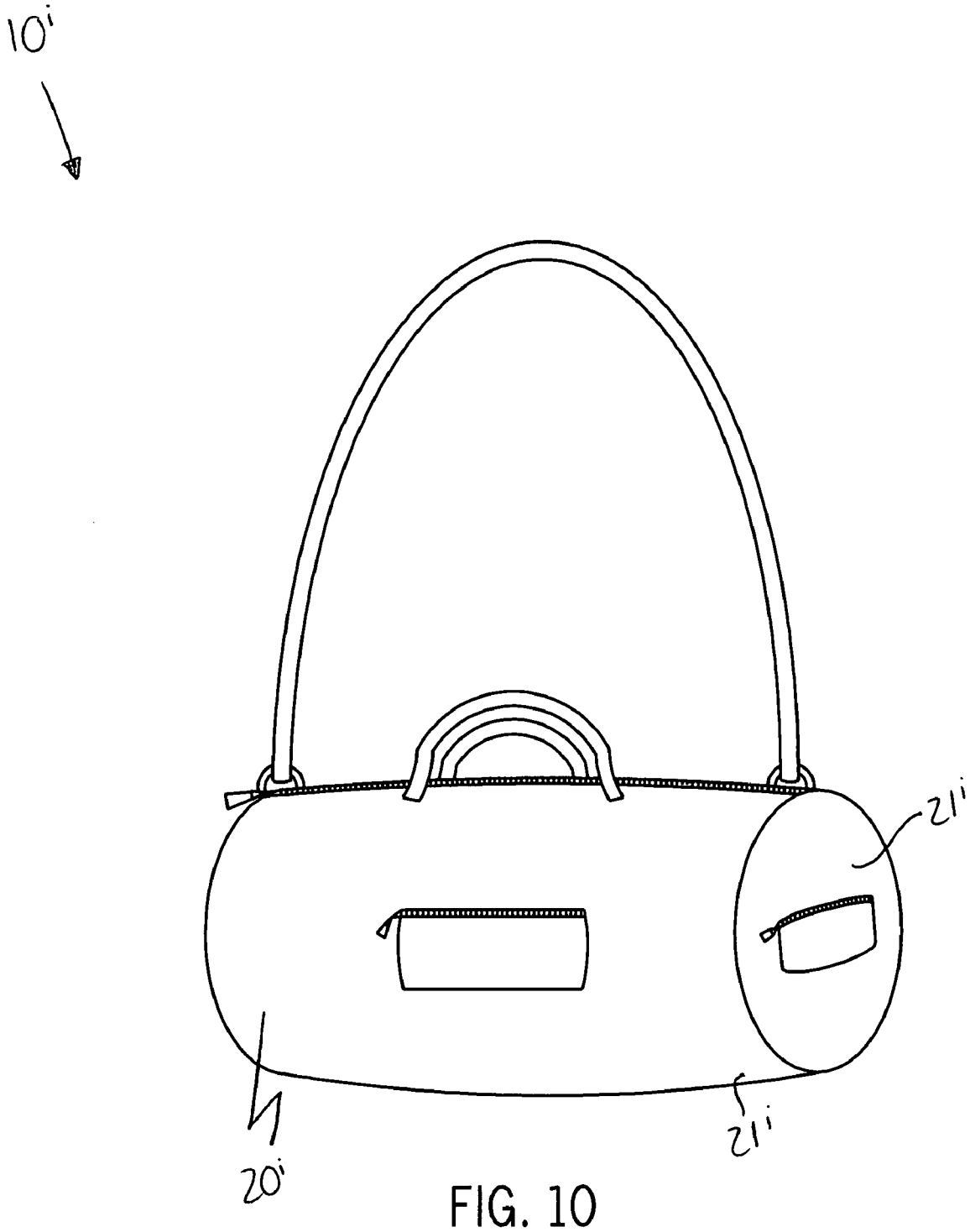
FIG. 10 is a front elevational view of an alternate embodiment of an illuminable cosmetic carrying bag, in accordance with the present invention.
Figure 11:
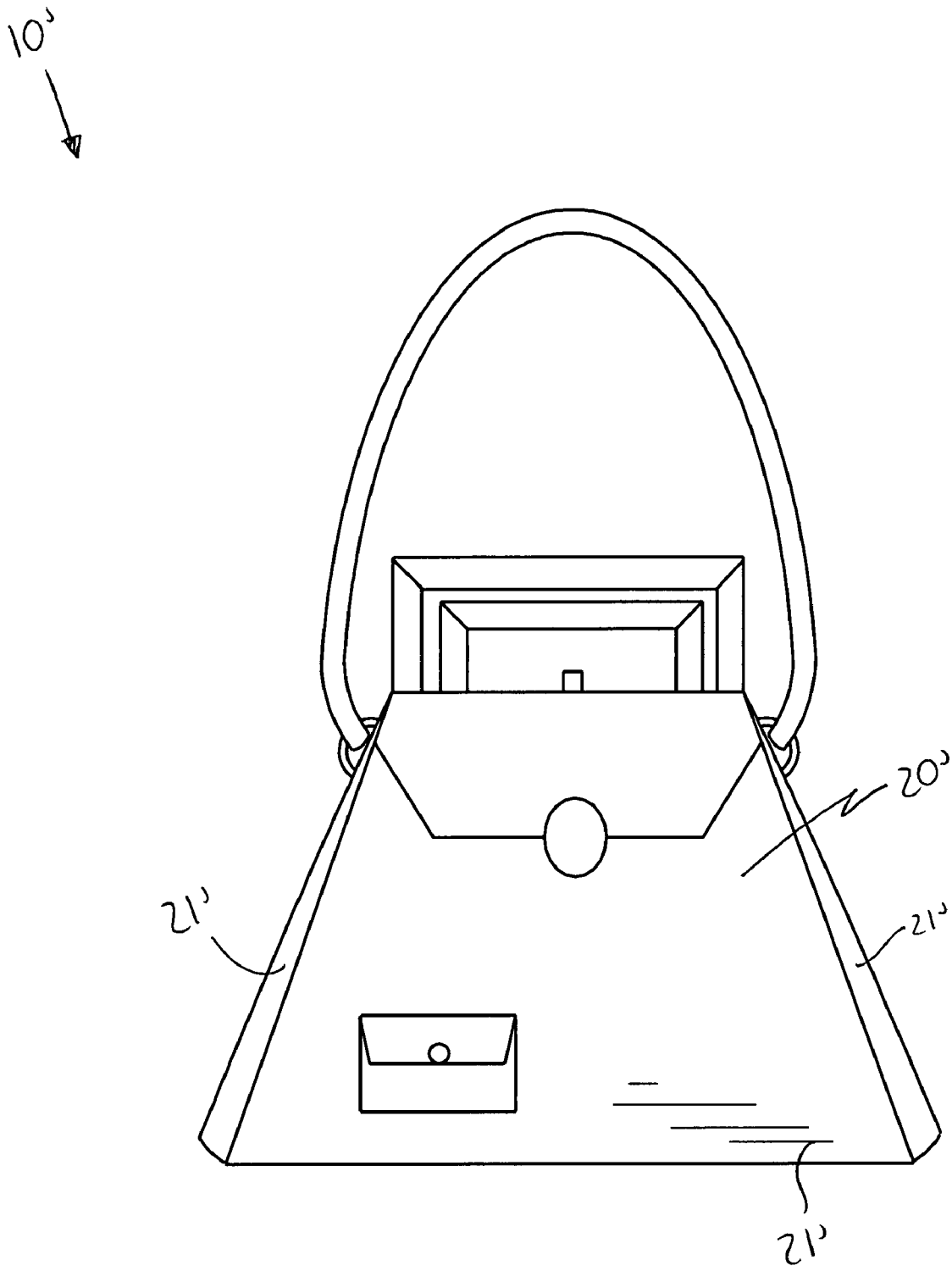
FIG. 11 is a front elevational view of an alternate embodiment of an illuminable cosmetic carrying bag, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-14 by the reference numeral 10 and is intended to protect an illuminable cosmetic carrying bag. It should be understood that the apparatus 10 may be used to illuminate many different types of bags and should not be limited to illuminating only those types of bags mentioned herein.

Referring initially to FIGS. 1-13, an illuminable cosmetic carrying bag 10 includes a body 20 with a plurality of walls 21 arranged in such a manner to create a storage chamber therein. One of such walls 21 is transparent and situated along an entire anterior side of the body 20, and the body 20 further has a protective flap 22 pivotally coupled to a bottom edge of the transparent wall. Such a protective flap 22 covers an entire surface area of the transparent wall 23 when articulated to a closed position. The body 20 is provided for housing a plurality of user products, as needed.

Figure 12:
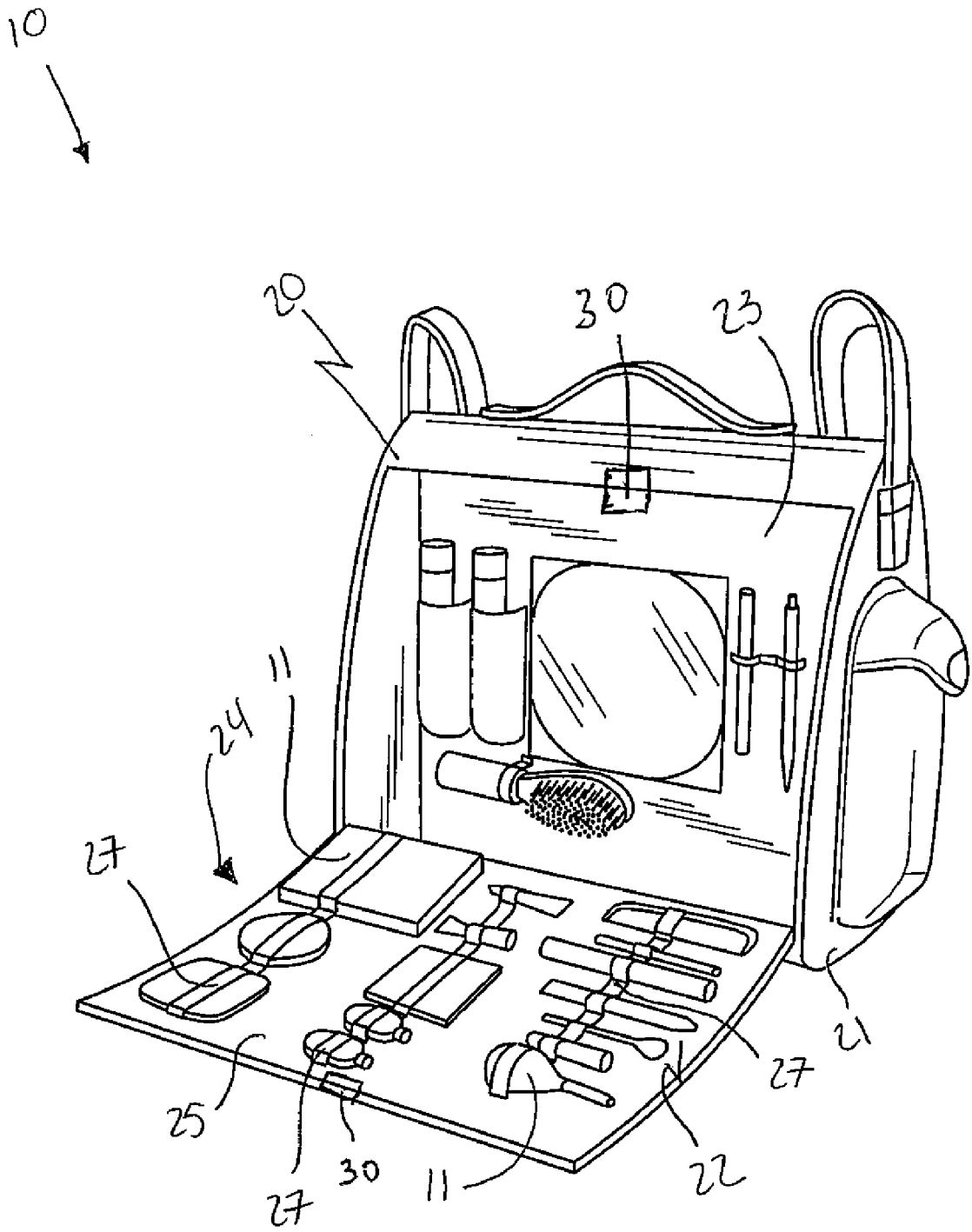
FIG. 12 is a perspective view of an illuminable cosmetic carrying bag, with the flap open, in accordance with the present invention.
Figure 13:
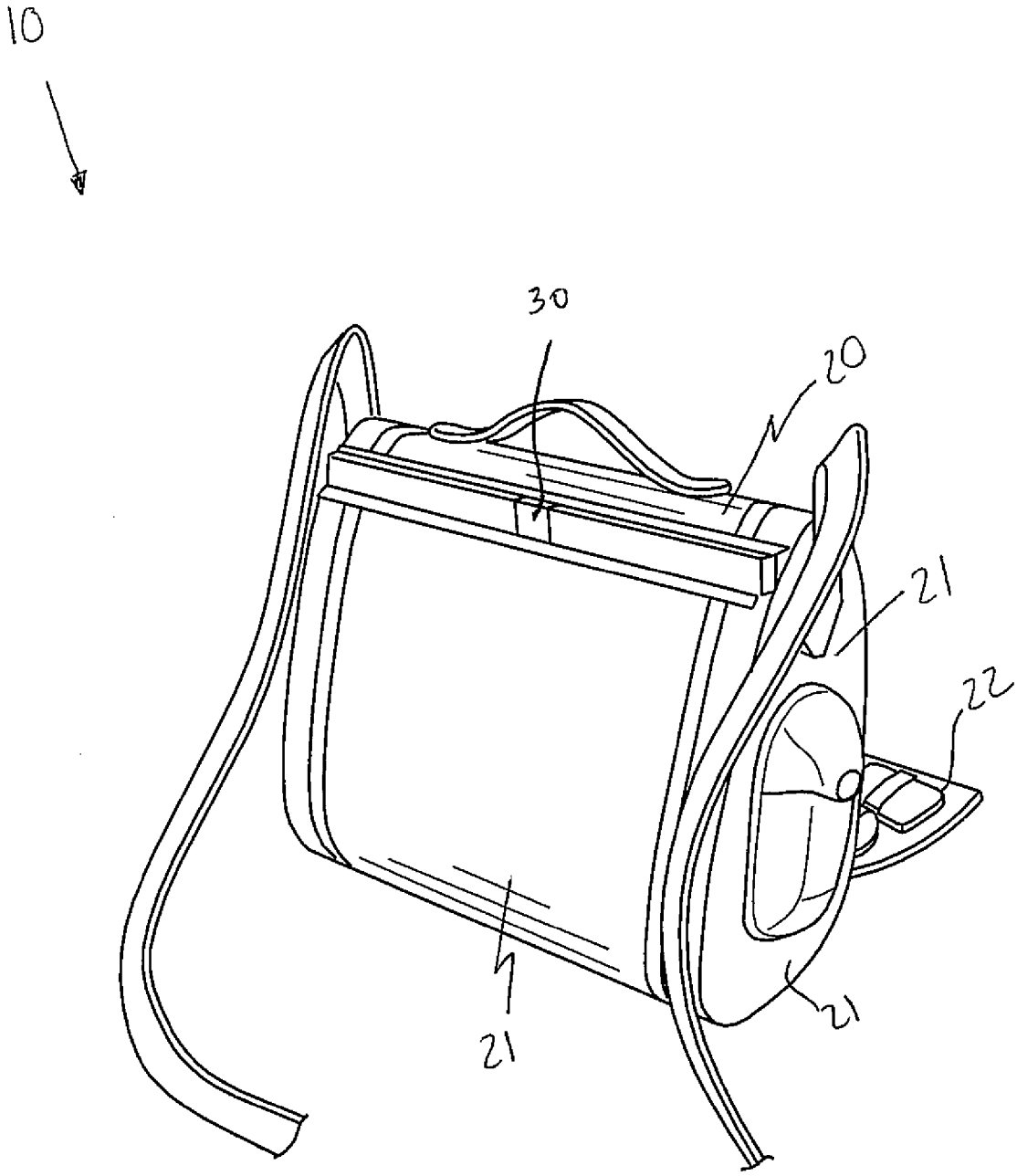
FIG. 13 is a rear elevational view of an illuminable cosmetic carrying bag, in accordance with the present invention.

Referring to FIG. 12, the device 10 further includes a mechanism 24 for removably displaying the cosmetic items on an interior face 25 of the protective flap 22. Such a cosmetic item displaying mechanism 24 automatically toggles the illuminating mechanism 26 between illuminated and non-illuminated modes when adapted between open and closed positions respectively. The cosmetic item displaying mechanism 24 includes a plurality of straps 27 adjustably attached to the interior face 25 of the protective flap 22. Such straps 27 hold the cosmetic items 11 along the interior face 25 and openly display the cosmetic items 11 when the protective flap 22 is adapted to an open position. The cosmic item displaying mechanism 24 ensures that cosmetics 11 are exposed only when desired by a user.

Figure 14:
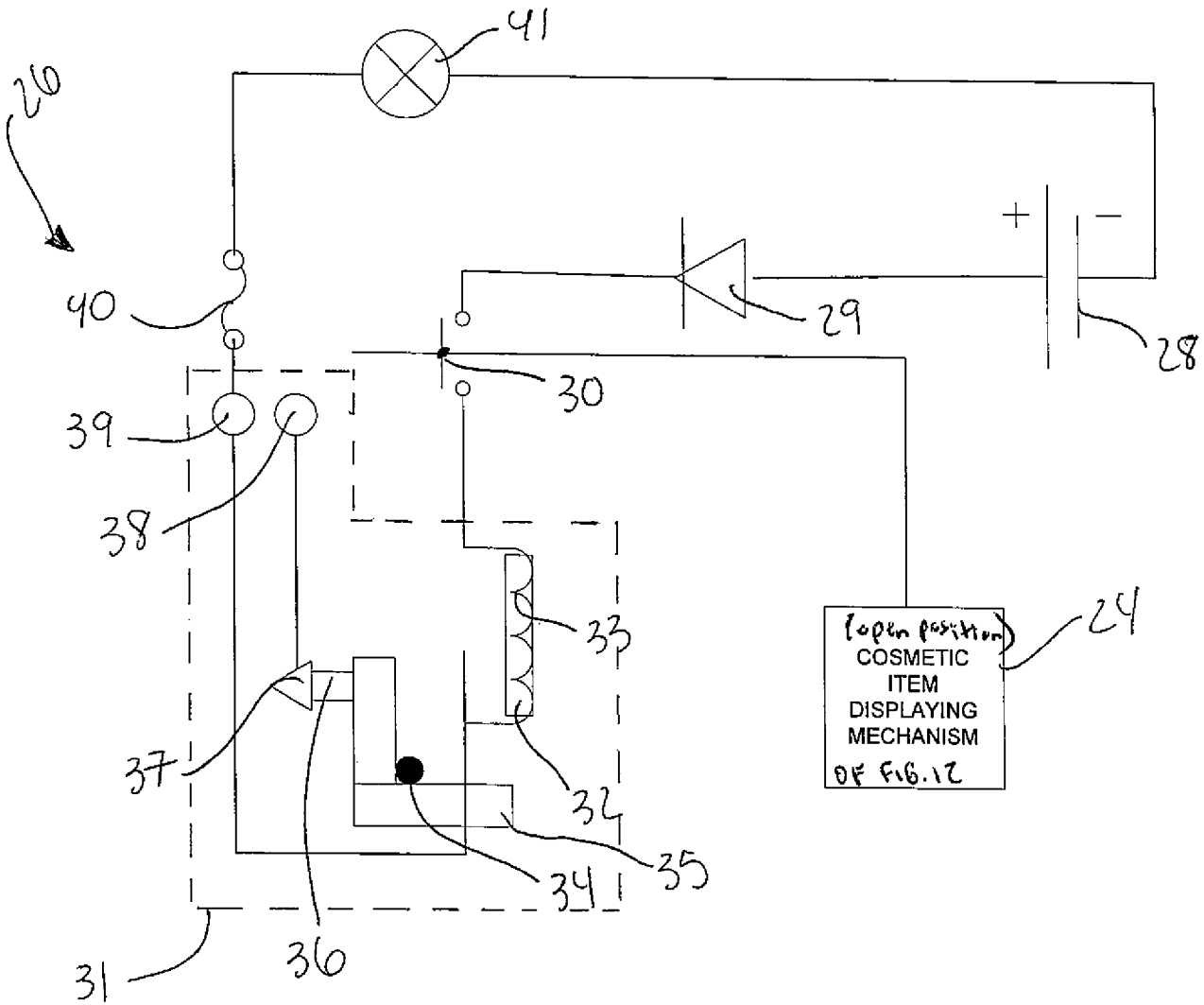
FIG. 14 is a schematic block diagram showing the illuminating mechanism automatically toggled to a non-illuminated position via the open electrical position of switch 30 when flap 22 of the cosmetic item displaying mechanism is opened (FIG. 12), in accordance with the present invention.
Figure 14A:
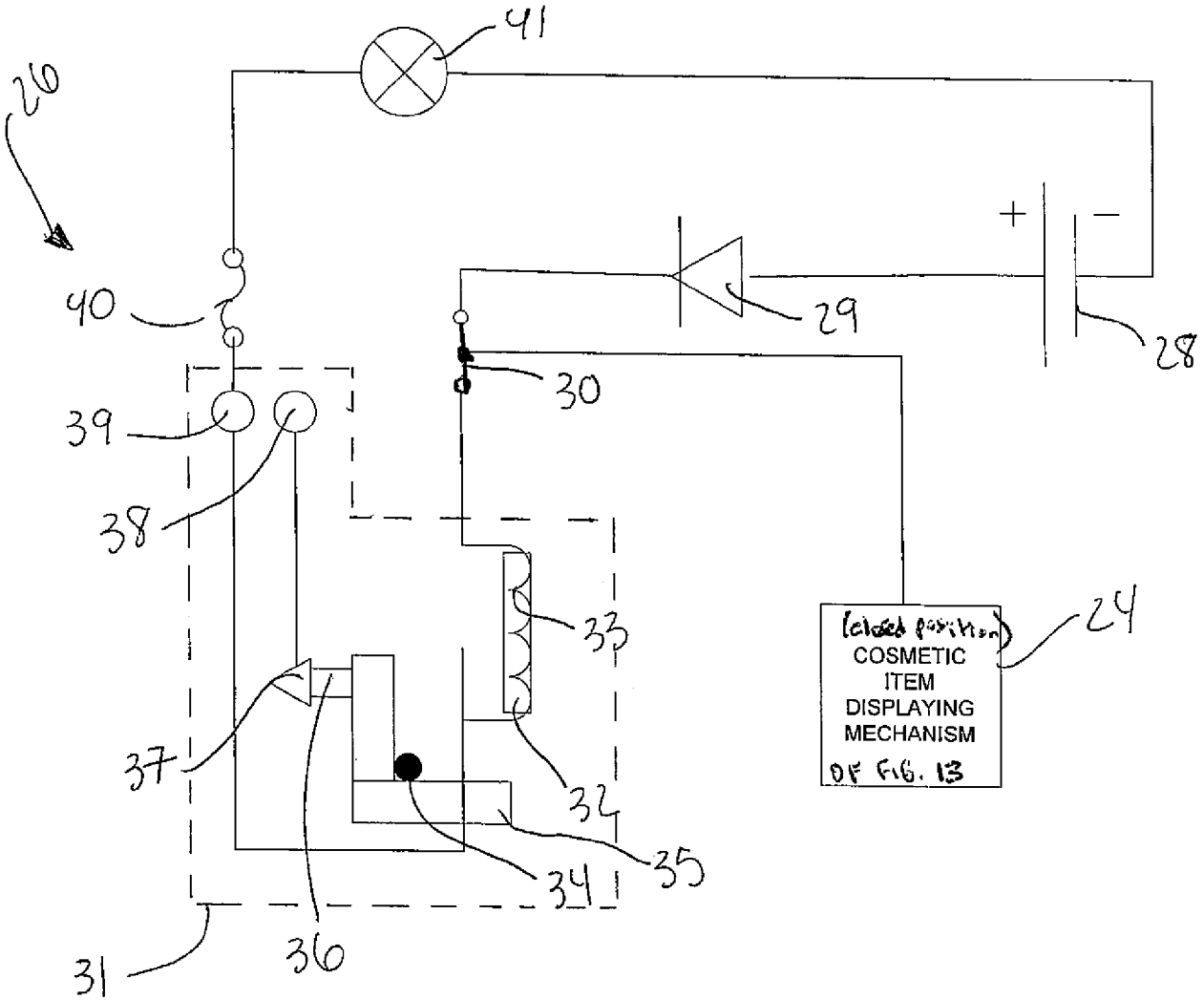
FIG. 14*a* is a schematic block diagram showing the illuminating mechanism toggled to an illuminated position via the closed electrical position of switch 30 when flap 22 of the cosmetic item displaying mechanism is closed (FIG. 13), in accordance with the present invention.

Referring to FIGS. 14 and 14*a*, the device 10 further includes a mechanism 26 for illuminating the storage chamber and the protective flap 22 which is essential so that the cosmetic items 11 are illuminated while displayed on the interior face 25 of the protective flap 22. Such an illuminating mechanism 26 includes a battery 28 and a diode 29 electrically coupled directly, without the use of intervening elements, to the battery 28 for ensuring that current flows in one direction. A switch 30 is electrically coupled to the diode 29 and positioned downstream thereof, and an electromagnetic conducting assembly 31 is electrically coupled directly, without the use of intervening elements, to the switch 30. Such an electromagnetic conducting assembly 31 includes a conductive core member 32, a conductive coil 33 helically wrapped about the core member 32, a pivot hinge 34 spaced from the core member 32, an L-shaped armature 35 pivotally mated to the pivot hinge 34, and an insulating rib 36 directly intercalated, without the use of intervening elements, between an end of the armature 35 and the conductive contact 37 respectively. Such a core member 32 and such a conductive coil 33 cooperate for generating an electromagnetic force that causes the armature 35 to pivot about the pivot hinge 34 and bias the conductive contact 37 to the second terminal and thereby transfer the current to the lamp.

Referring again to FIGS. 14 and 14*a*, the illuminating mechanism 26 further includes first and second terminals 38, 39 spaced apart and electrically disengaged when the switch 30 is adapted to an open position. A conductive contact 37 is attached to the first terminal 38, a fuse 40 is electrically coupled directly, without the use of intervening elements, to the second terminal 39, and a lamp 41 is electrically coupled directly, without the use of intervening elements, to the fuse 40. The battery 28 generates and transmits the current to the diode 29 when the switch 30 is adapted to a closed position by pivoting the cosmetic item displaying mechanism 24 to an open position and thereby allowing the current to be transmitted to the electromagnetic conducting assembly 31 for biasing the conductive contact along an arcuate path and thereby engaging the second terminal which is vital so that the current is allowed to freely flow through the fuse and illuminate the lamp. The illuminating mechanism 26 is automatically activated when the cosmetic displaying mechanism 24 is adapted to an open position.

In use, the handbag with an integral organizer compartment is simple and straight forward to operate. First, the user purchases a handbag according to their personal style and preference. By way of example, a busy executive might purchase a large, basic black handbag that includes several storage compartments and pouches. In this manner, the user can easily store and access important documents necessary for her work, as well as personal items such as cosmetics, a cellular telephone or a day planner. Similarly, a young college coed might purchase a brightly colored, beaded clutch handbag to correspond with a formal evening gown, thereby providing a fancy carryall for a winter or spring sorority dance. Next, the user simply utilizes the organizer as they would any other handbag, filling the bag's individual compartments with various accessories and personal items such as keys, cosmetics, breath mints, sanitary products and a wallet, retrieving and replacing these items as needed. After use, the user simply closes the apparatus and she is ready to go!

The device includes a line of fashionable handbags. Each handbag includes a plurality of alternately sized and shaped storage compartments, inside of which the many accessories can neatly be stored. The handbag includes two sides that are joined together via a durable zipper closure which expands about the entire outer perimeter thereof. Of course, as with traditional handbags, the apparatus could be produced in a variety of styles, sizes and shapes including but not limited to, small beaded evening bags, soft canvas clutch bags, box-style latched purses and oversized multi-pocketed leather totes, as is obvious to a person of ordinary skill in the art. Depending on the size of the handbag, the device can be provided with varying quantities of storage compartments. Such storage compartments are suitably sized and shaped to accommodate such items as a cellular telephone, eyeglasses, checkbook, compact, foundation, lipstick, eyeliner, blush brush, tissues, mirror and comb could all be included. Of course, a variety of alternate items may be stored within the compartments, as is obvious to a person of ordinary skill in the art. A loop-shaped holder on which the user can store their keys is also included and is positioned in an easily accessed location within the bag.

The present invention, as claimed, provides the unexpected and unpredictable benefit of a device that is convenient and easy to use, is durable yet lightweight in design, is versatile in its uses, and enables users to easily locate a variety of stored items from within their handbag, in a simple and efficient manner. As a cleverly designed handbag boasting a plethora of storage pockets and pouches, the organizer compartment advantageously provides instant access to cosmetics, keys, cellular telephones and any other stored items, quickly and conveniently. By eliminating the need to aimlessly hunt through one's purse when trying to locate stored goods in the evening hours or in darkened environments, use of the device ensures that one can find what they are looking for with little effort. Because of this important advantage, the organizer handbag can prove a valuable safety tool by enabling females to hastily locate keys, a cellular telephone, or even a small can of pepper spray, during an emergency situation. Another important advantage is that the present invention is a fully functioning handbag. Users appreciate that by utilizing the device they can easily store a variety of personal items.

In use, a method for storing and displaying cosmetic items includes the steps of: providing a body 20 with a plurality of walls 21 arranged in such a manner to create a storage chamber therein; pivotally coupling a protective flap 22 to a bottom edge of a transparent one 23 of the walls in such a manner that the protective flap 22 covers an entire surface area of the transparent wall 23 when articulated to a closed position; removably displaying the cosmetic items 11 on an interior face 25 of the protective flap 22; and automatically illuminating the storage chamber and the protective flap 22 so that the cosmetic items 11 are illuminated while displayed on the interior face 25 of the protective flap 22 when the cosmetic item displaying mechanism 24 is adapted between to an open position.

In use, the method further includes the steps of: providing a battery 28; electrically coupling a diode 29 electrically and directly to the battery 28 for ensuring that current flows in one direction; electrically coupling a switch 30 to the diode 29 by positioning the switch downstream of the diode 29; directly coupling an electromagnetic conducting assembly 31 directly to the switch 30; adapting the switch 30 to an open position; spacing apart first and second terminals 38, 39 by electrically disengaging the first and second terminals 38, 39; attaching a conductive contact 37 to the first terminal 38; electrically coupling a fuse 40 directly to the second terminal 39; electrically coupling a lamp 41 directly to the fuse 40; adapting the switch 30 to a closed position; the battery 28 to generating and transmitting the current to the diode 29 by pivoting the cosmetic item displaying mechanism 24 to an open position; transmitting the current to the electromagnetic conducting assembly 31; biasing the conductive contact 37 along an arcuate path; and the conductive contact 37 engaging the second terminal 39 so that the current is allowed to freely flow through the fuse 40 and illuminate the lamp 41.

In use, the method further includes the steps of: providing a conductive core member 32 and a conductive coil 33 helically wrapped about the core member 32; spacing a pivot hinge 34 from the core member 32; pivotally mating an L-shaped armature 35 to the pivot hinge 34; directly intercalating an insulating rib 36 between an end of the armature 35 and the conductive contact 37 respectively; and the core member 32 and the conductive coil 33 generating an electromagnetic force and thereby causing the armature 35 to pivot about the pivot hinge 34 and bias the conductive contact 37 to the second terminal 39 for transferring the current to the lamp 41.

In use, the method further includes the steps of: adjustably attaching a plurality of straps 27 to the interior face 25 of the protective flap 22; and positioning the cosmetic items 11 against the straps 27 in such a manner that the straps 27 hold the cosmetic items 11 along the interior face 25 and openly display the cosmetic items 11 when the protective flap 22 is adapted to an open position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An illuminable cosmetic carrying bag for storing and displaying cosmetic items, said illuminable cosmetic carrying bag comprising:

a body having a plurality of walls arranged in such a manner to create a storage chamber therein, one of said walls being transparent and situated along an entire anterior side of said body, said body further having a protective flap pivotally coupled to a bottom edge of said transparent wall, said protective flap covering an entire surface area of said transparent wall when articulated to a closed position;

means for removably displaying the cosmetic items on an interior face of said protective flap; and means for illuminating said storage chamber and said protective flap so that the cosmetic items are illuminated while displayed on said interior face of said protective flap;

wherein said illuminating means comprises:

a battery;

a diode electrically coupled directly to said battery for ensuring that current flows in one direction;

a switch electrically coupled to said diode and positioned downstream thereof;

an electromagnetic conducting assembly electrically coupled directly to said switch;

first and second terminals being spaced apart and electrically disengaged when said switch is adapted to an open position;

a conductive contact attached to said first terminal;

a fuse electrically coupled directly to said second terminal; and a lamp electrically coupled directly to said fuse;

wherein said battery generates and transmits said current to said diode when said switch is adapted to a closed position and thereby allows said current be transmitted to said electromagnetic conducting assembly for biasing said conductive contact along an arcuate path and thereby engaging said second terminal so that said current is allowed to freely flow through said fuse and illuminate said lamp.

2. The illuminable cosmetic carrying bag of claim 1, wherein said electromagnetic conducting assembly comprises:

a conductive core member;

a conductive coil helically wrapped about said core member;

a pivot hinge spaced from said core member;

an L-shaped armature pivotally mated to said pivot hinge; and an insulating rib directly intercalated between an end of said armature and said conductive contact respectively;

wherein said core member and said conductive coil cooperate for generating an electromagnetic force that causes said armature to pivot about said pivot hinge and bias said conductive contact to said second terminal and thereby transfer said current to said lamp.

3. The illuminable cosmetic carrying bag of claim 2, wherein said cosmetic item displaying means comprises: a plurality of straps adjustably attached to said interior face of said protective flap, said straps holding the cosmetic items along said interior face and openly displaying said cosmetic items when said protective flap is adapted to an open position.

4. An illuminable cosmetic carrying bag for storing and displaying cosmetic items, said illuminable cosmetic carrying bag comprising:

a body having a plurality of walls arranged in such a manner to create a storage chamber therein, one of said walls being transparent and situated along an entire anterior side of said body, said body further having a protective flap pivotally coupled to a bottom edge of said transparent wall, said protective flap covering an entire surface area of said transparent wall when articulated to a closed position;

means for removably displaying the cosmetic items on an interior face of said protective flap;

means for illuminating said storage chamber and said protective flap so that the cosmetic items are illuminated while displayed on said interior face of said protective flap;

wherein said protective flap automatically toggles said illuminating means between illuminated and non-illuminated modes when adapted between open and closed positions respectively;

wherein said illuminating means comprises:

a battery;

a diode electrically coupled directly to said battery for ensuring that current flows in one direction;

a switch electrically coupled to said diode and positioned downstream thereof;

an electromagnetic conducting assembly electrically coupled directly to said switch;

first and second terminals being spaced apart and electrically disengaged when said switch is adapted to an open position;

a conductive contact attached to said first terminal;

a fuse electrically coupled directly to said second terminal; and a lamp electrically coupled directly to said fuse;

wherein said battery generates and transmits said current to said diode when said switch is adapted to a closed position by pivoting said protective flap to an open position and thereby allows said current be transmitted to said electromagnetic conducting assembly for biasing said conductive contact along an arcuate path and thereby engaging said second terminal so that said current is allowed to freely flow through said fuse and illuminate said lamp.

5. The illuminable cosmetic carrying bag of claim 4, wherein said electromagnetic conducting assembly comprises:

a conductive core member;

a conductive coil helically wrapped about said core member;

a pivot hinge spaced from said core member;

an L-shaped armature pivotally mated to said pivot hinge; and an insulating rib directly intercalated between an end of said armature and said conductive contact respectively;

wherein said core member and said conductive coil cooperate for generating an electromagnetic force that causes said armature to pivot about said pivot hinge and bias said conductive contact to said second terminal and thereby transfer said current to said lamp.

6. The illuminable cosmetic carrying bag of claim 5, wherein said cosmetic item displaying means comprises: a plurality of straps adjustably attached to said interior face of said protective flap, said straps holding the cosmetic items along said interior face and openly displaying said cosmetic items when said protective flap is adapted to an open position.

7. A method for storing and displaying cosmetic items, said method comprising the steps of:

a. providing a body having a plurality of walls arranged in such a manner to create a storage chamber therein;

b. pivotally coupling a protective flap to a bottom edge of a transparent one of said walls in such a manner that said protective flap covers an entire surface area of said transparent wall when articulated to a closed position;

c. removably displaying the cosmetic items on an interior face of said protective flap;

d. automatically illuminating said storage chamber and said protective flap so that the cosmetic items are illuminated while displayed on said interior face of said protective flap when said protective flap is adapted between to open and closed positions;

wherein step d. comprises the steps of:

i. providing a battery;

ii. electrically coupling a diode electrically directly to said battery for ensuring that current flows in one direction;

iii. electrically coupling a switch to said diode by positioning said switch downstream of said diode;

iv. directly coupling an electromagnetic conducting assembly directly to said switch;

v. adapting said switch to an open position;

vi. spacing apart first and second terminals by electrically disengaging said first and second terminals;

vii. attaching a conductive contact to said first terminal;

viii. electrically coupling a fuse directly to said second terminal;

ix. electrically coupling a lamp directly to said fuse;

x. adapting said switch to a closed position;

xi. said battery to generating and transmitting said current to said diode by pivoting said protective flap to an open position;

xii. transmitting said current to said electromagnetic conducting assembly;

xiii. biasing said conductive contact along an arcuate path; and xiv. said conductive contact engaging said second terminal so that said current is allowed to freely flow through said fuse and illuminate said lamp.

8. The method of claim 7, wherein step iv. comprises the steps of:

providing a conductive core member and a conductive coil helically wrapped about said core member;

spacing a pivot hinge from said core member;

pivotally mating an L-shaped armature to said pivot hinge;

directly intercalating an insulating rib between an end of said armature and said conductive contact respectively; and said core member and said conductive coil generating an electromagnetic force and thereby causing said armature to pivot about said pivot hinge and bias said conductive contact to said second terminal for transferring said current to said lamp.

9. The method of claim 7, wherein step c. comprises the steps of:

adjustably attaching a plurality of straps to said interior face of said protective flap; and positioning the cosmetic items against said straps in such a manner that said straps hold the cosmetic items along said interior face and openly display said cosmetic items when said protective flap is adapted to an open position.

* * * * *